US011148923B2

(12) United States Patent
Ziegler et al.

(10) Patent No.: US 11,148,923 B2
(45) Date of Patent: Oct. 19, 2021

(54) DEVICE AND METHOD FOR FILLING A CONTAINER WITH A FILLING PRODUCT

(71) Applicant: KRONES AG, Neutraubling (DE)

(72) Inventors: Manfred Ziegler, Neutraubling (DE); Florian Angerer, Neutraubling (DE)

(73) Assignee: KRONES AG, Neutraubling (DE)

( * ) Notice: Subject to any disclaimer, the term of this patent is extended or adjusted under 35 U.S.C. 154(b) by 266 days.

(21) Appl. No.: 16/490,441

(22) PCT Filed: Mar. 2, 2018

(86) PCT No.: PCT/EP2018/055166
§ 371 (c)(1),
(2) Date: Aug. 30, 2019

(87) PCT Pub. No.: WO2018/158424
PCT Pub. Date: Sep. 7, 2018

(65) Prior Publication Data

US 2021/0284517 A1 Sep. 16, 2021

(30) Foreign Application Priority Data

Mar. 2, 2017 (DE) ..... 10 2017 104 343.8

(51) Int. Cl.
*B67C 3/28* (2006.01)
*B67C 3/00* (2006.01)

(52) U.S. Cl.
CPC ..... *B67C 3/282* (2013.01); *B67C 3/007* (2013.01)

(58) Field of Classification Search
CPC ..... B67C 3/282; B67C 3/007
(Continued)

(56) References Cited

U.S. PATENT DOCUMENTS 2,324,782 A 7/1943 Kronquest
4,691,496 A * 9/1987 Anderson ..... B65B 57/10 141/144

(Continued)

FOREIGN PATENT DOCUMENTS

DE 19602655 A1 7/1997
DE 102011075459 A1 11/2011
JP 2006240659 A 9/2006

*Primary Examiner* — Jason K Niesz
(74) *Attorney, Agent, or Firm* — Maschoff Brennan

(57) ABSTRACT

A device for filling a container with a filling product, preferably for filling a glass container with a beverage in a bottling plant, comprising a filling valve for introducing the filling product into the container to be filled, a control device for controlling the filling valve, and a filling level sensor which communicates with the control device for detecting the presence of a target filling level ($H_S$) of the filling product in the container, the control device being configured to close the filling valve upon detection of the target filling level ($H_S$), the control device being configured to determine the presence of the target filling level ($H_S$) by means of the filling level sensor again after the filling valve has been closed and to initiate an ejection process for the container if it is detected that the target filling level ($H_S$) has been undershot.

20 Claims, 4 Drawing Sheets

(58) Field of Classification Search
USPC ..... 141/95
See application file for complete search history.

(56) References Cited

U.S. PATENT DOCUMENTS 5,538,054 A * 7/1996 L uhmann ..... B67C 3/007 141/198
2007/0107801 A1* 5/2007 Cochran ..... G01F 13/006 141/153

* cited by examiner

DEVICE AND METHOD FOR FILLING A CONTAINER WITH A FILLING PRODUCT

TECHNICAL FIELD

The present invention relates to a device for filling a container with a filling product, in particular for filling a glass container with a carbonated beverage in a bottling plant. The present invention also relates to a method for filling a container with a filling product.

TECHNICAL BACKGROUND

In bottling plants, it is known to fill containers to be filled with a filling product in a filling device, for example, in a filler in a carousel-type design. In this process, the flow of the filling product flowing into the container to be filled is controlled using a filling valve. In order to control or regulate the starting and ending of the filling product flow and in order to achieve a desired final filling level in the container to be filled, different ways of determining the completion of the filling are known.

For example, to obtain a specified filling level and thus to achieve a uniform appearance of the filled containers, it is known to determine the filling level in the container with a return gas tube immersed in the container or with a level probe, and to close the filling valve when the desired level is reached.

Methods are also known for filling glass bottles and other containers with carbonated filling products in bottling plants. In order to reduce an excessive release of the bound $CO_2$ in the carbonated filling product during the actual filling of the container with the filling product and to reduce or prevent excessive foaming of the filling product, which could lead to a reduction in the filling speed, it is known to pressurize the containers with a pressurizing gas, preferably $CO_2$, before filling and then to fill up the pressurized container with the carbonated filling product.

Before the containers filled with the carbonated filling product are transferred via a outlet device, such as an outlet starwheel, to a subsequent processing station, for example a closing device, a controlled relief of the pre-applied pressure from the inside of the then filled container to the ambient pressure then takes place, so that the containers can be transferred without strain to the subsequent outlet device.

Not all of the containers that are fed to the filler are completely intact. In particular, in the case of glass containers, small cracks or leaks may be present in the containers to be filled. Accordingly, it can happen to such containers that are not intact, during the pressurization of the container or when filling the container with the carbonated filling product, that the entire container sometimes ruptures due to the high pressure inside the container. If the container is already severely damaged, in the vast majority of cases this rupturing already takes place at the pressurization stage with the pressurizing gas.

It is known to remove any shards or container residues produced by the rupture of a container from the respective filling valve, for example by spraying with a spray device. Furthermore, in this context it is known also to clean possible shards or splinters of the broken container from the filling valve and the channels of the filling valve that convey the filling product, for example by rinsing out the channels conveying the filling product with filling product.

In the event of complete rupture or destruction of the container, this can be detected mechanically. This mechanical detection can take place, for example, by virtue of the fact that the clamping device, which is used to clamp the container onto the filling valve itself in a sealed manner, reacts to the shattering of the container. For example, the shattering of the container can also be detected by the falling or lowering of a centering bell. The rupture can also be detected by the sudden drop in a clamping force of the container onto the fill valve.

The mechanical detection of a complete container fracture is known, for example, from DE 21 07 226 C3, in which the integrity of the container is verified using a mechanical scanning process.

However, in some cases a defective container does not result in a complete collapse or rupture of the container, instead the outer dimensions of the container remain essentially intact—even when the pressurizing gas is introduced under pressure. However, the defective container is leaky, because, for example, it has a relatively small or large hole or a minor or major crack and/or multiple cracks, such that media can escape from the container interior to the outside. If such a defective container does not break during the pressurization process, it is filled inside the filling machine in the normal way. If the container does not break during the filling process either, in conventional filling devices it is subsequently transferred to the outlet device. It can then break at any subsequent point in time during the further processing—for example in the following closing device, which in turn subjects the container to large forces to apply the lid. The container can also break at a later stage of the procedure, for example during labeling, palletizing or even during transport. This can lead to high additional costs, because, for example a whole package may need to be disposed of.

DE 42 03 786 A1 discloses a filling device in which the occurrence of a container rupture is detected by a measurement probe that responds to liquid, which can detect the inadmissible escape of filling product from the container resulting from the destruction of the container, but also as a result of a hole or crack in the container. For this to work, however, it is necessary for appropriate liquid-sensitive detectors to be present in the area of the containers.

WO02/079036 A1 discloses devices for dispensing filling products in composite packages, in which optical, electrical/electronic or mechanical detectors or weighing devices are used to detect faults in the packaging material.

DESCRIPTION OF THE INVENTION

On the basis of the known prior art, an object of the present invention is to specify a further improved device and method for filling liquid products into containers to be filled, which enables a simple detection of container faults.

This object is achieved by a device for filling a container with a filling product having the features of claim 1. Advantageous developments are derived from the dependent claims, the present description and the figures.

Accordingly, a device for filling a container with a filling product is proposed, preferably for filling a glass container with a carbonated beverage in a bottling plant. The device comprises a filling valve for introducing the filling product into the container to be filled, a control device for controlling the filling valve, and a filling level sensor communicating with the control device to detect the presence of a target filling level of the filling product in the container, wherein the control device is configured to close the filling valve on detecting the target filling level. According to the invention, the control device is configured to determine the presence of the target filling level by means of the filling level sensor again after the filling valve has been closed, and to initiate an ejection process for the container if it is detected that the target filling level has been undershot.

Because the control device is configured to detect the filling level of the filling product in the container by means of the filling level sensor again after the filling valve has been closed, and to initiate an ejection process for the container if the target filling level is undershot, the detection of container faults can be achieved without the use of additional sensors. In particular, this means that it is not necessary to assign another sensor to each filling valve, by means of which potentially escaping filling product can be detected. A mechanical scanning for the presence or absence of the container to be filled is also not absolutely necessary. Rather, due to the fact that the filling level sensor detects once again after the closure of the filling valve, if the target level is (still) present, it is possible to check whether the filled container meets the requirements to which it is subject.

In the proposed manner it can be detected, for example, if a container has a small leakage or crack through which filling product is escaping, but the container itself still appears to be mechanically intact and is not yet shattered. In particular, the filling process ends by the filling valve being closed on the basis of the sensor signal of the filling level sensor, which signals the attainment of the target filling level. At a later time, for example after the conclusion of a settling phase for the filling product, using the same filling level sensor the filling level is then measured again, which due to the faulty container and the resulting escaping filling product, however, has then fallen. Due to the escaped filling product the filling product level inside the container therefore no longer corresponds to the specified target filling level, which can be determined by the filling level sensor. It can thus be concluded from the decrease in the filling level that the container is defective.

The control device can also be configured to close the filling valve after the expiry of a normal filling time, even if the target filling level has not yet been reached. In this case also, at a later time after the closure of the filling valve it can be detected by means of the filling level sensor that the target filling level has not (ever) been reached. This may also be used to conclude that a container is defective. In this way, even the complete absence of a container can be detected, since the filling product then flows out through the filling valve until the normal filling time has elapsed and the filling valve is then automatically closed. The filling level sensor cannot then detect a filling level after the closure of the filling valve, since there is no container present.

The filling level sensor can be a filling level probe which is inserted into the interior of the container to be filled and has a sensor section that defines the target filling level, wherein the sensor section is preferably a short-circuit sensor, a capacitive sensor and/or a resistance sensor.

The fact that the filling level sensors already provided in a probe filler are also used to detect whether the container may not meet the sealing requirements allows a particularly efficient design of the device to be achieved. Therefore, the provision of additional sensors or other control devices than the devices already provided for the actual filling process is not necessary.

Instead, via the control device and the filling level sensor, after the actual closure of the filling valve and thus after the completion of the supply of the filling product into the container, the level present at the time is measured again. In this way it is possible to check whether the specified target filling level in the container is being maintained or whether the filling product level is dropping. If in the determination of the filling product level after the closure of the filling valve the target filling level is not (or no longer) reached, it can be concluded that the container is leaky and filling product has therefore escaped.

The filling level sensor can preferably also be implemented by an optical filling level determination device and, in particular, implemented by an optical filling level determining device arranged outside of the container to be filled, particularly preferably in the form of a camera and/or an optical scanning device.

The filling level of the filling product in the container to be filled can therefore be determined, for example, by providing optical sensors or, for example, a camera, by means of which the filling product level in the container to be filled is determined during the filling process. The signal of such a filling level sensor is used firstly for terminating the filling process when a specified target filling level is reached, in order to then close the filling valve accordingly.

After closing the filling valve, the filling level then present in the filled container is determined again at a later time using this filling level sensor. If this level is below the target filling level, it is then concluded that the container is leaking and filling product has therefore escaped.

The measurement after closing the filling valve preferably takes place at a time after the dispensed filling product has settled down and any overrun from the filling valve, which may still be dripping after the filling valve is closed, has ceased. Depending on the design of the filling device, the repeated determination of the filling level can take place, for example, 100 ms to 200 ms after closing the filling valve.

The control device preferentially initiates an ejection process on the detection of an incorrectly filled container, so that the incorrectly filled container, which is assumed to be faulty, is not delivered to the subsequent processing stations. In particular, it is thus possible to prevent the filled but defective container from breaking at a subsequent processing station in any case, due to the mechanical loads applied there, and from contaminating these following areas with shards and filling product.

The control device is preferably configured to initiate the ejection process by marking the container as defective in a shift register. Accordingly, the initiation of the ejection process can be achieved, for example, by a notice being entered in the shift register in which the respective containers are recorded during their passage through the filling device, to the effect that the container is faulty and hence needs to be subsequently ejected. After the filling device a corresponding ejection gate is preferably then provided, by means of which the container can then be rejected based on its marking in the shift register.

Preferably, a container transport device is provided for transporting the container to be filled during the introduction of the filling product into the container to be filled and the control device is configured to initiate the ejection process by stopping the container transport device, the control device being preferably configured to control the container transport device to stop via a dynamic stop ramp, and particularly preferably to stop the container to be ejected in a safe service position.

The control device thus initiates an ejection process by stopping the transport of the containers through the filling device, for example by the fact that a dynamic stop ramp for a carousel-type filler device is traversed and the transport device is accordingly stopped in a defined manner.

In other words, the control device, on determining that a certain container is under-filled and is therefore assumed to have lost the missing filling product due to leakage, can initiate the ejection process by stopping the filler carousel such that the container detected as faulty comes to a stop in a safe service position. In this safe service position the faulty container can be removed by an operator intervention. In the safe service position, the faulty container can also be removed using an appropriate automated device, for example, a service robot. Subsequently, the corresponding filling valve can be cleaned or cleansed.

The safe service position is particularly preferably provided in an area in which the defective container has not yet been passed to a subsequent transport device or even to a subsequent processing or machining device. Preferably, the control device therefore stops the transport device in a defined manner, so that the container comes to rest in the safe service position before the transfer to a outlet transport device and, in particular, before the transfer to an outlet starwheel, in order to be removed from there. This reduces the risk that the non-intact container might break already during the transfer to the outlet transport device due to the mechanical stresses.

An optical display is preferably provided, via which the container detected as faulty can be marked to make it easy for an operator to selectively remove the container.

In this way it can be ensured that the defective container is not passed into subsequent processing sections, and accordingly no splintered material due to a possibly bursting container is entered into subsequent processing areas.

The control device is preferably configured to close the filling valve after the expiry of a normal filling time, even if the target filling level has not (yet) been reached. This results in a closure of the filling valve in the normal case by the fact that the target filling level is reached. If the normal maximum filling time is not sufficient to reach the target filling level, however, then the filling valve closes after the expiry of the normal filling time. The container is then already underfilled at this time. The subsequent repeated determination of whether the target fill level is (still) present, accordingly results in the finding that the container is not compliant with the requirements and must therefore be ejected.

The control device is preferably configured to determine the presence of the target filling level again only after the expiry of a settling phase, preferably after the expiry of a settling phase of 50 ms to 500 ms, preferably of 100 ms to 200 ms after the closing of the filling valve. The settling phase is usually scheduled between the end of the filling process and the beginning of a pressure relieving process, to reduce the unwanted discharge of filling product together with the relief gas. In the settling phase, any foam that may be produced can also at least partially subside. By performing the repeated determination of the filling level only after the expiry of the settling phase, if there is a defect in the container then a corresponding effect of the drop in the filling level can be clearly detected.

The object referred to above is also achieved by a method having the features of claim 8. Advantageous developments are derived from the dependent claims, the description and the figures.

Accordingly, a method for filling a container with a filling product, preferably for filling a glass container with a beverage in a bottling plant, is proposed, wherein a filling valve for introducing the filling product into the container to be filled, a control device for controlling the filling valve, and a filling level sensor which communicates with the control device for detecting the presence of a target filling level of the filling product in the container, are provided and wherein the control device is configured to close the filling valve on detection of the target filling level. According to the invention, the control device determines the presence of the target filling level by means of the filling level sensor again after the filling valve has been closed and initiates an ejection process for the container if it is detected that the target filling level has been undershot.

The above advantages already indicated for the device are derived as a result.

BRIEF DESCRIPTION OF THE DRAWINGS

Further preferred embodiments and aspects of the present invention are explained in more detail in the following description of the figures. The figures show.

DETAILED DESCRIPTION OF PREFERRED EXEMPLARY EMBODIMENTS

Figure 1:
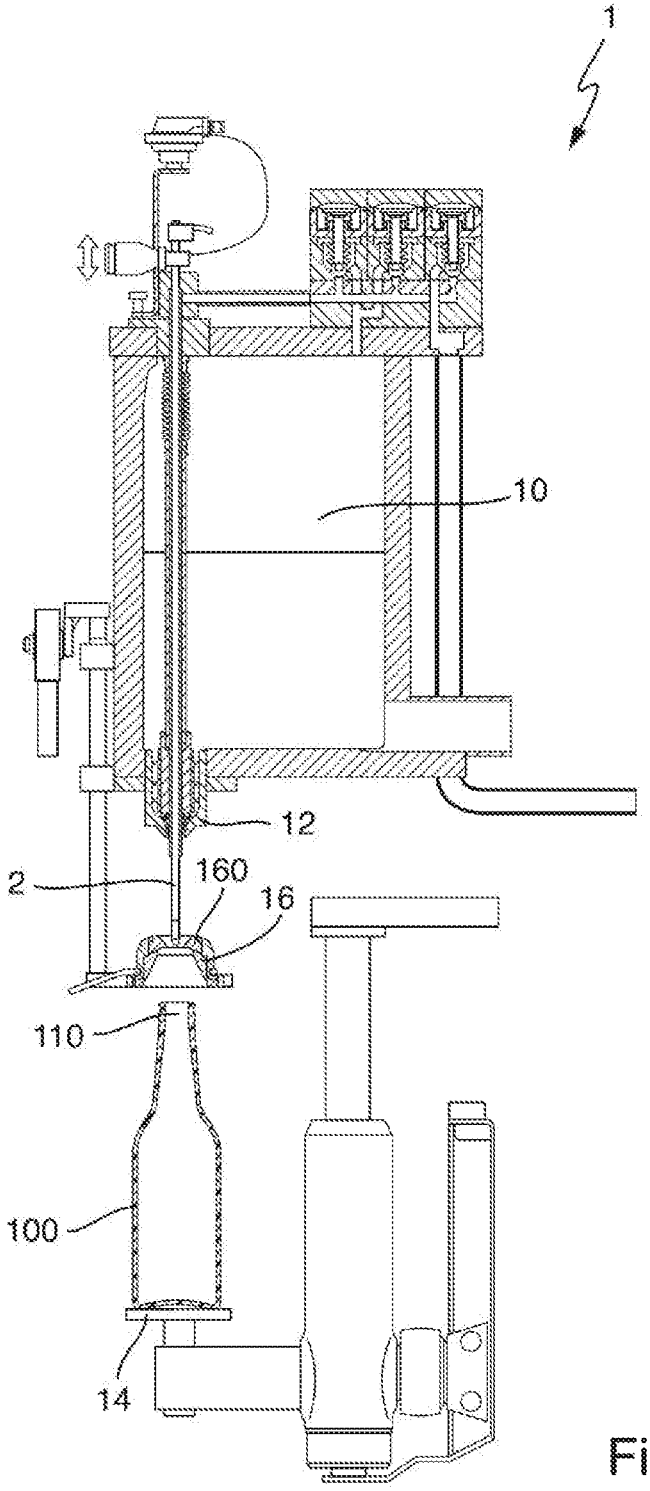
FIG. 1 a schematic representation of a device for filling a container with a filling product, in which a container to be filled is currently in the process of being supplied to a filling valve, FIG. 2 a schematic representation of the device from FIG. 1, wherein the container is clamped onto the filling valve, the container is filled with filling product and the inflow of filling product is completed, FIG. 3 a schematic representation of the progress of the filling level over time in an intact container to be filled, FIG. 4 a schematic representation of the progress of the filling level over time in two different non-intact containers to be filled, FIG. 5 a schematic representation of the sensor signal of the filling level sensor during the filling of an intact container, FIG. 6 a schematic representation of the sensor signal of the filling level sensor during the filling of the two non-intact containers from FIG. 4, and FIG. 7 a schematic illustration of a filling carousel.

In the following, preferred exemplary embodiments are described by reference to the figures. In these, similar or equivalent-acting elements in the various figures are labeled with identical reference numerals, and a repeated description of these elements is partially omitted in order to avoid redundancy.

FIG. 1 schematically shows a cross-sectional view through a section of a device 1 for filling a container 100, shown schematically in the form of a glass bottle, with a filling product. The filling product is available in a filling product reservoir 10 of the device 1 and can be dispensed into the container 100 via a filling valve 12 through the mouth 110 of said container.

In FIG. 1 a container 100 to be filled is currently in the process of being fed to the fill valve 12 via a container transport device in the form of a transport plate 14. A centering of the mouth 110 of the container 100 with respect to the filling valve 12 is achieved via a centering bell 16, into which the mouth 110 of the container 100 to be filled is inserted. Due to the upward movement of the container 100 in the direction of the filling valve 12 by raising of the transport plate 14, the centering bell 16 is carried along by the mouth 110 of the container 100.

In the centering bell 16 in the exemplary embodiment shown, a seal 160 is provided, which is brought into sealed contact with the mouth 110 of the container 100 by the upward movement of the container 100. The centering bell 16 continues to be raised together with the container 100 by means of the transport plate 14 until the seal 160 is also brought into sealed contact with the filling valve 12 and a fluid- and, in particular, gas-tight connection is therefore made between the mouth 110 and the filling valve 12, as is apparent, for example, in FIG. 2.

In a bottling plant usually a plurality of filling valves 12 is available, which are arranged around the circumference of a filler carousel and revolve together with the filler carousel, in order to fill the containers 100 to be filled in a continuous process. In doing so, one container 100 to be filled at a time is held below a respective filling valve 12 and transported by the container transport device in the form of the transport plate 14. The filler carousel thus enables the production of a stream of containers filled with the filling product.

The filling product reservoir 10 in the schematic exemplary embodiment shown is embodied in the form of a ring bowl, which is also connected to the filler carousel and circulates together with the latter. The structure of the device 1, and in particular of the filler carousel, may also follow other known structures, however, for example by the use of a rotating or stationary central bowl and the connection of the filling valves 12 by means of a circular pipeline.

During the upward movement of the container 100 a filling level sensor 2 is introduced through the mouth 110 into the interior of the container 100. The filling level sensor 2 comprises a sensor section 20, as is known, which can determine the filling product level inside the container 100. In particular, the sensor section 20 of the filling level sensor 2 can be designed so that it detects when the filling product level inside the container 100 reaches the sensor section 20. Then the filling level sensor 2 outputs a corresponding shut-off signal to a control device, not shown. The sensor section 20 of the filling level sensor 2 can be implemented, for example, as a capacitive sensor, as a short-circuit sensor and/or as a resistance sensor.

In order to achieve a reliable filling of the container 100 with the filling product, the filling valve 12 is closed when the filling level sensor 2 of the control device indicates accordingly via the shut-off signal that the filling product has reached the sensor section 20. By means of the fixed geometrical relationship of the filling level sensor 2 and, in particular, of the sensor section 20 to the mouth 110 of the container 100, it can thus be ensured that the containers 100 filled by means of the device 1 receive essentially the same filling level, and so a particularly uniform filling pattern can be achieved.

The filling level of the filling product in the container 100 usually does not correspond exactly to the insertion depth of the sensor section 20 in the container 100, since in generating the shut-off signal by the filling product level reaching the sensor section 20, a delay occurs in the closure of the filling valve 12 due to the inertia thereof. In addition, the filling product already located below the filling valve 12 can no longer be influenced by the filling valve 12, so that a corresponding overrun occurs. Under the assumption that both inertia and overrun are substantially the same for all filling valves 12 of a filling device, a uniform filling pattern of the filled containers 100 is then nevertheless obtained.

Figure 2:
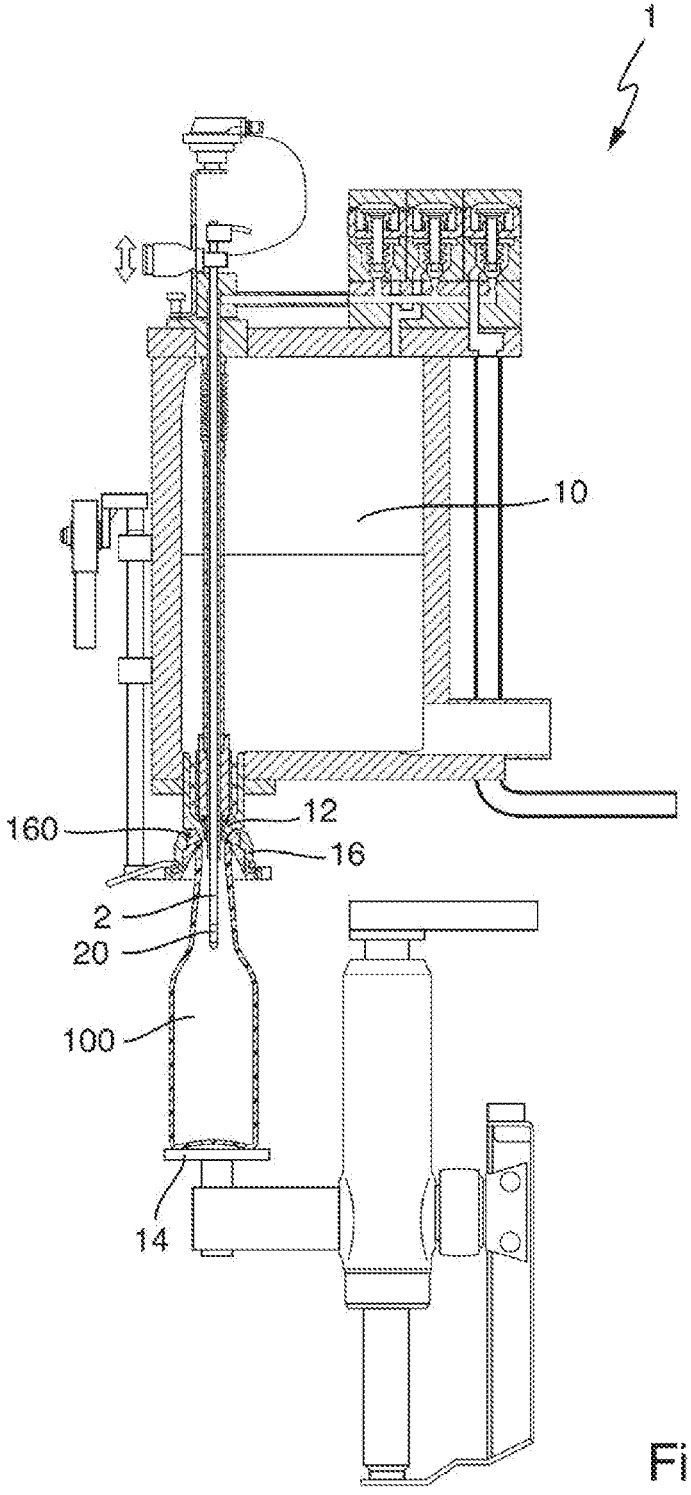

In FIG. 2, the container 100 is shown in a position in which it is clamped to the filling valve 12 and the filling process has already been completed. The filling level sensor 2 is still inserted into the interior of the container 100 and has prompted the control device by means of the appropriate signals to close the filling valve 12, since the filling product level has reached the sensor section 20. Due to the inertia of the filling valve 12 and due to the overrun, the filling level is thus located above the sensor section 20 after the completion of the filling process.

FIG. 2 shows the state that the container 100 is in after the filling valve 12 is closed, if the filling valve 12 has been closed by an appropriate signaling of the filling level sensor 2 and the container 100 is intact. The filling level shown in FIG. 2 is therefore maintained.

Figure 3:
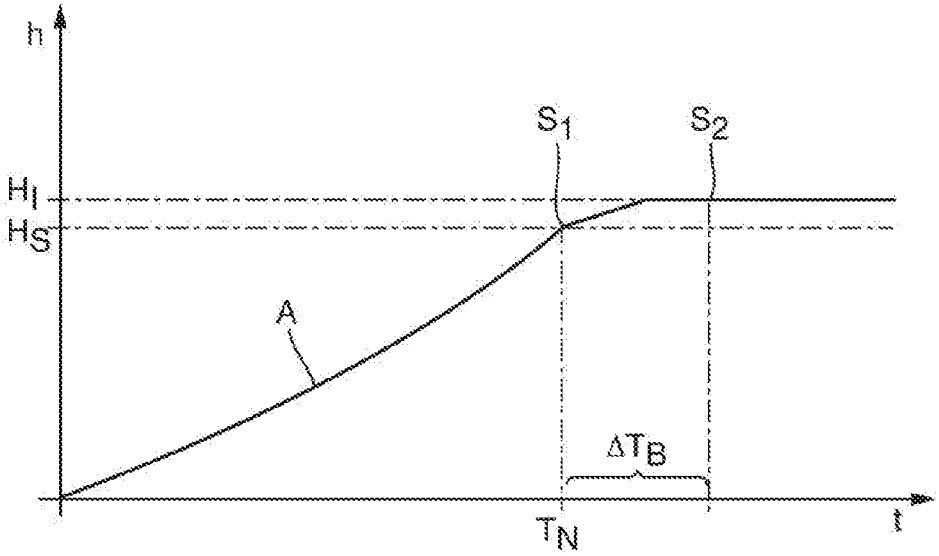

FIG. 3 shows a schematic profile of a curve A of the filling level of such a filling process against time, wherein an intact container 100 is present here.

It is apparent that over the course of time, the filling takes place until the target fill level $H_S$ specified by the sensor section 20 is reached at the first sensor measurement $S_1$. At this time, corresponding to the normal filling time $T_N$, the filling valve 12 is closed on the basis of the shut-off signal specified by the filling level sensor 2. It turns out that the filling level continues to increase slightly, since an overrun of filling product also takes place and the closure of the filling valve 12, due to the inertia thereof, requires a finite time after reaching the filling level $H_S$. Between the switching of the filling valve 12 and the actual attainment of the maximum filling level therefore, a slight overrun occurs, which results in the actual filling level $H_I$.

After the closure of the filling valve 12, for an intact container 100 as shown by the filling curve A, the resulting fill level $H_I$ is therefore above the target fill level $H_S$, so that the filling level sensor 2 still outputs a signal at a later, second sensor measurement $S_2$, which can be used to conclude that the sensor section 20 has been reached. In other words, for an intact container 100 the target filling level $H_S$ is not undershot even at a later measurement after some time.

The second sensor measurement $S_2$ is preferably performed after a settling phase $\Delta T_B$ is finished. The settling phase $\Delta T_B$ is usually between 100 ms and 200 ms. The settling phase is then followed by the pressure relieving process to relieve the pressure in the container to normal atmospheric pressure in a controlled manner, to prevent the carbonated filling product being ejected out of the filled container 100 when the latter is detached from the filling valve 12.

Figure 5:
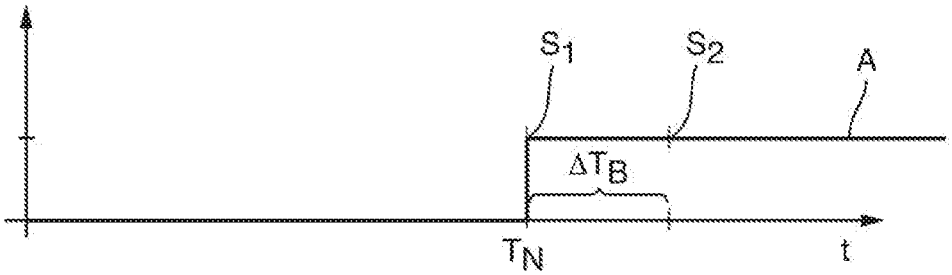

Accordingly, in a filling level sensor 2, which has only a single sensor section 20, the sensor signal behaves as shown schematically in FIG. 5. The sensor signal of the sensor section 20 is therefore constantly present once the target filling level specified by the sensor section 20 has been reached.

Figure 4:
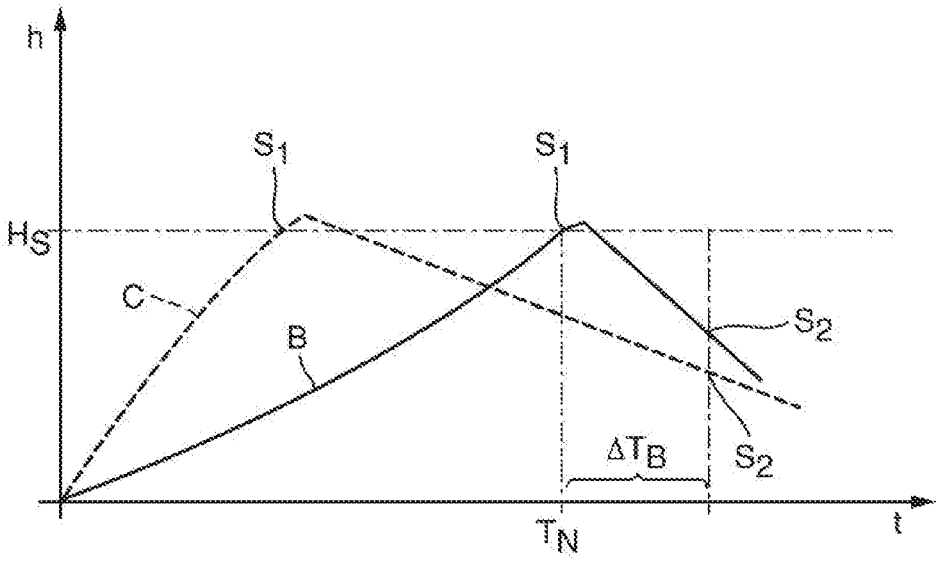

FIG. 4 shows two different filling curves B and C, which can be produced when non-intact containers are present.

In the filling curve B a non-intact container is shown which has only a relatively small leak, so that the filling time corresponds substantially to the filling time of an intact container. Due to the small leak, an escape of the filling product occurs, so that after the filling valve 12 is closed, which is triggered by the sensor measurement $S_1$ at time $T_N$, at a later time the filling level $H_S$ is no longer present. In other words, at the time of the second sensor measurement $S_2$ the filling level sensor 2 can no longer output a positive sensor signal.

Figure 6:
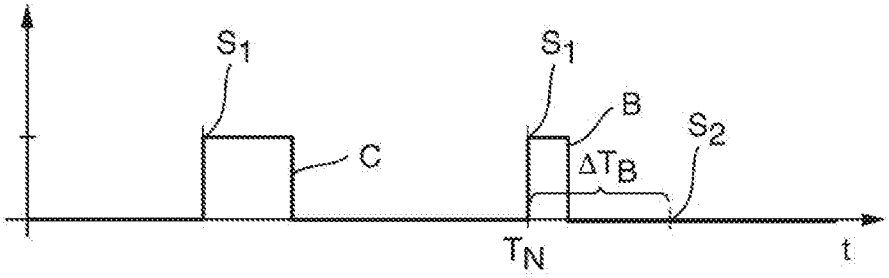

This results in the sensor switching curve B shown schematically in FIG. 6. At the time of the second sensor measurement $S_2$ the filling level sensor 2 therefore no longer delivers a positive sensor signal.

FIG. 4 shows a further example filling curve C, in which a particularly fast filling of the container 100 takes place because a back pressure cannot be built up in the reservoir 100 due to a major leak, and the filling product can therefore flow quickly into the container. The filling valve 12 is thus moved to the closed position at an earlier time of the sensor measurement $S_1$. At the time of the subsequent sensor measurement $S_2$, by contrast, a positive signal of the filling level sensor 2 is no longer detected.

This results in the schematic sensor switching curve C shown in FIG. 6. At the time of the second sensor measurement $S_2$ the filling level sensor 2 therefore no longer delivers a positive sensor signal.

Accordingly, on the basis of the response of the filling level sensor 2 after the filling valve 12 is closed, it is possible to determine whether the filled container 100 is intact or whether it has a leak through which filling product escapes from the container 100, causing an under-filling to be detected at the second sensor measurement $S_2$.

If the control device detects such a response of the filling product sensor 2 after the closure of the filling valve 12, then it is concluded that the container 100 is faulty. The control device accordingly initiates an ejection action for this container 100 detected as faulty, in order to remove the faulty container 100 from the production process.

For the ejection, the container 100 can be marked as faulty by the control device, for example in a shift register, so that the container can then be ejected in a subsequent device. For example, by using the shift register it can be ensured that the container is removed from the production process by means of a subsequent ejection gate of a downstream transport device.

On a certain shift register position being reached, or as soon as the faulty container is detected by the control device, a stop operation of a transportation device, such as a filler carousel, of the device for filling the container can also be initiated by the control device. The stop operation of the transport device is preferably controlled in such a way that the faulty container is brought to a halt in a safe service position, so that an operator can safely remove the faulty container from the device and, if necessary, clean and hygienically treat the filling valve.

As an example of an ejection action, the control device can initiate a corresponding stop ramp, which brings the rotary carousel or another container transport device to a halt in such a way that the faulty container comes to a halt in the safe service area. By traversing the dynamic stop ramp the transport device comes to a gentle stop, which results in in a safe and product-conserving stop for the other containers.

In an alternative, instead of the operator the removal of the faulty container can also be achieved by means of a corresponding automated device, for example by means of a robot arm or another ejection device.

Figure 7:
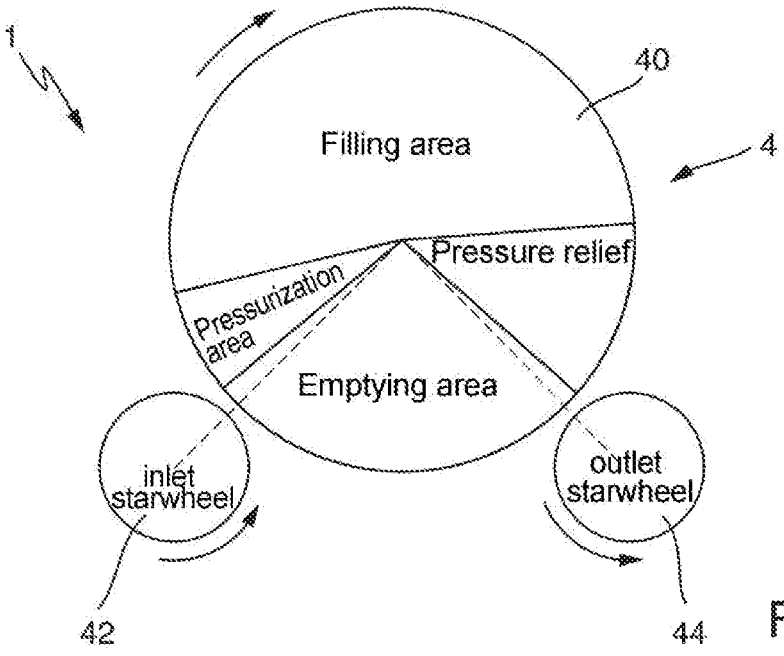

FIG. 7 shows a schematic representation of a device 1 for filling a container, which comprises the actual filler 4 or the filler carousel 40, an inlet starwheel 42 for feeding the containers to be filled to the filler carousel 40, and an outlet starwheel 44 for discharging the containers filled with the filling product in the filler carousel 40. Around the circumference of the filler carousel a plurality of the filling valves 12 shown, for example, in FIGS. 1 and 2, is provided.

On the basis of this schematic representation of the device 1 an exemplary treatment of a container 100 to be filled is described once again below.

By means of the inlet starwheel 42, a container to be filled is transferred to an appropriate container transport device of the filler carousel—for example, to a transport plate 14 as shown in FIGS. 1 and 2.

Directly after the inlet starwheel 42, by detecting an upward movement of the centering bell 16 it can be determined whether or not a container has been supplied to the appropriate filling body on the filler carousel 40. Specifically, if the centering bell 16 does not move upwards together with the transport plate 14 to press the mouth 110 of the container to be filled on to the filling valve 12, then it can be already assumed here that no container has been transferred to the corresponding transport plate, and hence the filling valve 12 is not opened at all thereafter.

If an upward movement of the centering bell 16 does take place, however, it is assumed that a container to be filled is present.

In the pressurizing area the container is then pressurized appropriately with a pressurizing gas, to prepare it for the subsequent filling operation. Accordingly, carbonated products can be dispensed into the pressurized container.

If the container breaks under the application of the pressure by means of the pressurizing gas, this breakage can then be detected by a lowering of the centering bell 16, if the container ruptures completely and the mouth area of the container falls down accordingly. In such a case, appropriate measures can then be initiated to remove the shards.

However, if the container is merely leaking but does not lose its mechanical integrity, then the centering bell 16 does not drop down, so that a detection of the defect in the container cannot be verified by means of the behavior of the centering bell 16. Instead, in such a case the control device of the device 1 for filling the container then assumes that the container is present at the respective position and can be filled, so that the filling process can be carried out in the filling area and the fill valve 12 is opened and closed according to the respective filling program. In particular, in a filling program for carrying out a level filling, the filling valve 12 is closed again when the filling level sensor 2 detects that a specified target filling level of the filling product in the container has been reached.

Accordingly, after the detection by the filling level sensor 2 that the container has been filled up to the target filling level, the filling valve 12 is closed. After the expiry of a settling phase, which is, for example, in the region of 100 ms to 200 ms, the pressure existing in the container 100 is then discharged in a controlled manner in the pressure relieving area of the container and then transferred via the outlet starwheel 44 to the following treatment devices.

In order then to verify that the filled container is actually intact or whether it has a leak, after the closure of the filling valve 12, particularly preferably after the end of the settling phase, the filling level inside the container is measured a second time by means of the filling level sensor 2 already used to determine the end of the filling process. In other words, the filling level is measured again after completion of the filling process.

In this way—as has already been described above—it can be determined whether the container initially filled with the filling product has lost filling product again in the meantime. If this is the case and the filling level sensor 2 detects that filling product has escaped from the container 100, it is assumed that the container is defective.

The filling process can also be terminated by the expiry of a specified maximum filling time, which is defined, for example, by the maximum possible filling angle of a rotary filler, without the filling level sensor 2 having indicated the target level being reached once. In this case also, after the conclusion of the designated period for the settling of the filling product, the filling level can be measured again by means of the filling level sensor 2.

Accordingly, by an evaluation of the filling level by means of the filling level sensor 2, an under-filling of the container, and thus an incorrectly filled container and/or non-intact container can be detected after the completion of the filling process.

If as a possible ejection action the control device triggers a pause in the movement of the container transport device and, in particular, of the filler carousel, then the incorrectly filled container will be brought to a halt preferably in a safe service area before it would have been transferred to the outlet starwheel 44. In this way it can be ensured that the mechanical loads on the non-intact container 100, which is therefore prone to breakage, are kept to a minimum and thus a potential ingress of shards into other areas of the plant can be reduced or even prevented.

In accordance with common practice, the various features illustrated in the drawings may not be drawn to scale. The illustrations presented in the present disclosure are not meant to be actual views of any particular apparatus (e.g., device, system, etc.) or method, but are merely idealized representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absence a showing that the terms "first," "second," "third," etc., connote a specific order, these terms should not be understood to connote a specific order. Furthermore, absence a showing that the terms first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

If applicable, all individual features shown in the exemplary embodiments can be combined and/or interchanged without departing from the scope of the invention.

The invention claimed is:

1. A device configured to fill a container with a filling product, the device comprising:

a filling valve configured to introduce the filling product into the container to be filled;

a filling level sensor, the filling level sensor configured to detect a presence of a target filling level ($H_S$) of the filling product in the container; and a control device communicatively coupled with the filling valve and the filling level sensor, the control device configured to:

control the filling valve by directing the filling valve to close in response to detection of the target filling level ($H_S$), after closure of the filling valve, checking the presence of the target filling level ($H_S$) again, and in response to determining that the target filling level ($H_S$) has been undershot, initiate an ejection process for the container.

2. The device of claim 1, wherein the filling level sensor is a filling level probe which is to be inserted into an interior of the container to be filled and which has a sensor section which defines the target filling level ($H_S$), wherein the sensor section is selected from a group comprising: a short-circuit sensor, a capacitive sensor, and a resistance sensor.

3. The device of claim 1, wherein the control device is configured to initiate the ejection process by marking the container in a shift register as defective.

4. The device of claim 1, wherein the container is a glass container and the filling product is a beverage.

5. The device of claim 1, wherein the filling level sensor is implemented by an optical filling level determining device arranged outside of the container to be filled.

6. The device of claim 5, wherein the optical filling level determining device is a camera or an optical scanning device.

7. The device of claim 1, further comprising a container transport device communicatively coupled with the control device, the container transport device configured to provide transportation for the container to be filled during the introduction of the filling product into the container, wherein the control device is configured to initiate the ejection process by stopping the container transport device.

8. The device of claim 7, wherein the control device is configured to control the container transport device to stop via a dynamic stop ramp with the container to be ejected in a safe service position.

9. The device of claim 1, wherein the control device is further configured to direct closure of the filling valve after expiry of a normal filling time ($T_N$) even if the target filling level ($H_S$) has not been reached.

10. The device of claim 9, wherein the control device is further configured to determine the presence of the target filling level ($H_S$) again only after expiry of a settling phase ($\Delta T_B$) that occurs after the closing of the filling valve.

11. The device of claim 1, wherein the control device is further configured to determine the presence of the target filling level ($H_S$) again only after expiry of a settling phase ($\Delta T_B$) that occurs after the closing of the filling valve.

12. The device of claim 11, wherein the settling phase ($\Delta T_B$) is in a range of 50 ms to 500 ms.

13. The device of claim 12, wherein the settling phase ($\Delta T_B$) is in a range of 100 ms to 200 ms.

14. A method for filling a container with a filling product, the method comprising:

introducing the filling product into the container to be filled by a filling valve;

detecting a presence of a target filling level ($H_S$) of the filling product in the container;

in response to detecting the target filling level ($H_S$), closing the filling valve;

after closing the filling valve, checking again for the presence of the target filling level ($H_S$); and in response to the target filling level ($H_S$) being undershot based on checking again for the presence of the target filling level ($H_S$), initiating an ejection process for the container.

15. The method of claim 14, wherein the ejection process includes marking the container in a shift register as defective.

16. The method of claim 14, wherein the filling valve is closed in response to detecting the target filling level ($H_S$) or in response to expiry of a normal filling time, ($T_N$).

17. The method of claim 14, further comprising transporting the container to be filled during the introduction of the filling product into the container with a container transport device, wherein the ejection process includes stopping the container transport device.

18. The method of claim 17, wherein the container transport device is stopped via a dynamic stop ramp such that the container is ejected in a safe service position.

19. The method as claimed in claim 14, wherein the presence of the target filling level ($H_S$) is determined again only after expiry of a settling phase ($\Delta T_B$) that occurs after closing the filling value.

20. The method of claim 19, wherein the settling phase ($\Delta T_B$) is in a range of 50 ms to 500 ms.

* * * * *